US007245729B2

(12) United States Patent
Bank et al.

(10) Patent No.: US 7,245,729 B2
(45) **Date of Patent: *Jul. 17, 2007**

(54) LOUDSPEAKER

(75) Inventors: Andrew D. Bank, Bedford (GB); Ian D. MacFarlane, Irthlingborough (GB); Keith D. Hills, Huntingdon (GB); Paul Burton, Huntingdon (GB)

(73) Assignee: New Transducers Limited, London (GB)

( * ) Notice: Subject to any disclaimer, the term of this patent is extended or adjusted under 35 U.S.C. 154(b) by 808 days.

This patent is subject to a terminal disclaimer.

(21) Appl. No.: 10/116,764

(22) Filed: Apr. 5, 2002

(65) Prior Publication Data

US 2002/0159610 A1 Oct. 31, 2002

Related U.S. Application Data

(60) Provisional application No. 60/331,719, filed on Nov. 21, 2001, provisional application No. 60/303,785, filed on Jul. 10, 2001, provisional application No. 60/281,807, filed on Apr. 6, 2001.

(30) Foreign Application Priority Data

| | | |
|---|---|---|
| Apr. 5, 2001 | (GB) | 0108504.2 |
| Jul. 3, 2001 | (GB) | 0116305.4 |
| Nov. 20, 2001 | (GB) | 0127788.8 |

(51) Int. Cl.
*H04R 25/00* (2006.01)

(52) U.S. Cl. ..... 381/152; 381/423; 381/186

(58) Field of Classification Search ..... 181/148, 181/198, 199, 163, 164; 381/152, 186, 345, 381/423, 424, 425, 429, 431
See application file for complete search history.

(56) References Cited

U.S. PATENT DOCUMENTS

| | | | | |
|---|---|---|---|---|
| 4,122,911 | A | | 10/1978 | Croup |
| 5,646,378 | A | | 7/1997 | Van Haaff et al. |
| 5,732,140 | A | | 3/1998 | Thayer |
| 5,979,591 | A | * | 11/1999 | Harrison ..... 181/199 |
| 6,332,029 | B1 | | 12/2001 | Azima et al. |

FOREIGN PATENT DOCUMENTS

| | | | |
|---|---|---|---|
| FR | 2688971 A1 | * | 9/1993 |
| GB | 1 582 183 | | 12/1980 |
| GB | 2 382 256 A | | 5/2003 |
| JP | 05-153681 | * | 6/1993 |
| JP | 11-113086 | | 4/1999 |
| JP | 2000-236595 | | 8/2000 |
| WO | WO 97/09855 A2 | | 3/1997 |

(Continued)

*Primary Examiner*—Sinh Tran
*Assistant Examiner*—Brian Ensey
(74) *Attorney, Agent, or Firm*—Foley & Lardner LLP

(57) ABSTRACT

A loudspeaker includes a box-form structure made from stiff lightweight sheet material to define a plurality of faces, at least one face of the structure forming a panel-form bending wave acoustic radiator, and an electro-acoustic vibration transducer coupled thereto to apply bending wave energy to the radiator to cause it to radiate an acoustic output when an input signal is applied to the transducer. The box-form structure is collapsible, so that the box-form structure can be stored and transported in a flat form and erected as a box when required as a loudspeaker.

32 Claims, 14 Drawing Sheets

FOREIGN PATENT DOCUMENTS

| | | |
|---|---|---|
| WO | WO 98/43464 A1 | 10/1998 |
| WO | WO 98/52381 A2 | 11/1998 |
| WO | WO 98/53638 A2 | 11/1998 |
| WO | WO 00/28781 A1 | 5/2000 |
| WO | WO 00/36875 A2 | 6/2000 |

* cited by examiner

FIG. 6C
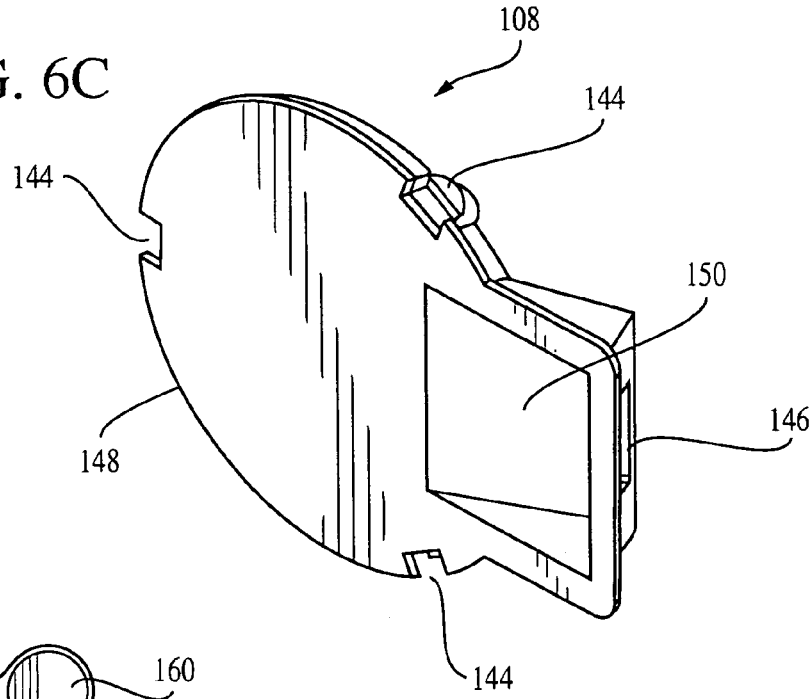
FIG. 6D
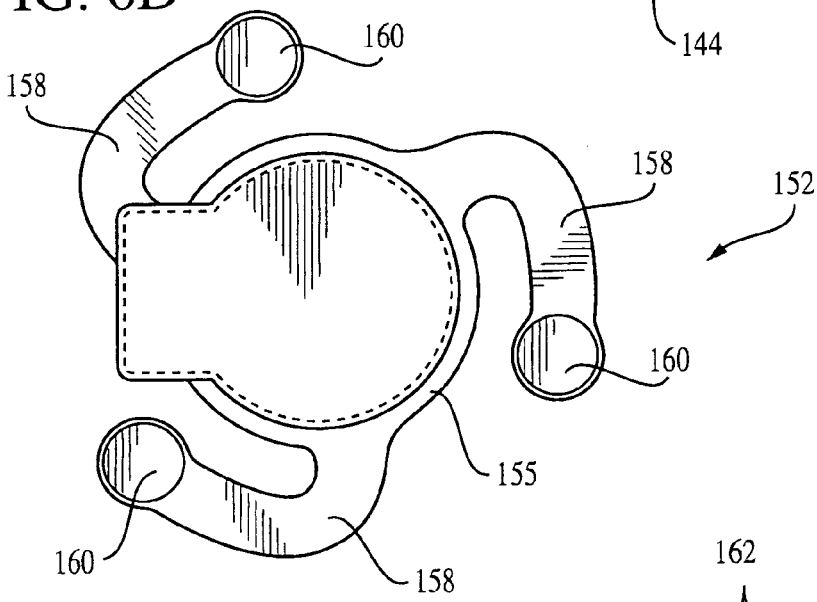
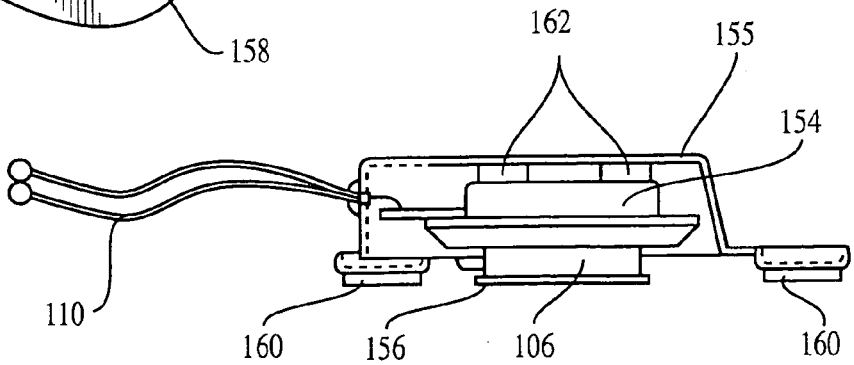
FIG. 6E

LOUDSPEAKER

This application claims the benefit of provisional application Nos. 60/281,807, filed Apr. 6, 2001; 60/303,785, filed Jul. 10, 2001 and 60/331,719, filed Nov. 21, 2001.

BACKGROUND

1. Technical Field

The invention relates to loudspeakers and more particularly to bending wave panel-form loudspeakers, e.g. of the kind generally described in U.S. Pat. No. 6,332,029 (incorporated by reference herein in its entirety).

2. Background Art

It is known from W097/09855 to provide packaging comprising a distributed mode panel-form loudspeaker.

SUMMARY OF THE INVENTION

According to the invention there is provided a loudspeaker comprising a box-form structure made from stiff lightweight sheet material to define a plurality of faces, at least one face of the structure forming a panel-form bending wave acoustic radiator and having an electro-acoustic vibration transducer coupled thereto to apply bending wave energy to the radiator to cause it to radiate an acoustic output when an input signal is applied to the transducer, the box-form structure being collapsible, so that the box-form structure can be stored and transported in a flat form and erected as a box when required as a loudspeaker.

A stiff material is one which is self-supporting. The box-form structure may be made from folded stiff lightweight sheet material that is sufficiently flexible at the folds to allow flat-packing. Thus, the box-form structure may comprise a single piece of the lightweight material which should greatly simplify manufacture and assembly. The fold between at least two adjacent faces may be a single fold or may comprise a parallel pair of folds. Such a double fold may provide extra compliance and more decoupling between faces. The folds may be formed by grooving the sheet material and the grooving may comprise local compression of the sheet material.

Alternatively, particularly if the box-form structure comprises a plurality of panels made from stiff lightweight sheet material which is not foldable, the panels may be united at the panel edges by connectors, e.g. adhesive tape. The connectors preferably comprise hinge portions whereby the panels are moveable relative to one another.

The folds or the connectors may be continuous or discontinuous. The folds or connectors may be such as to permit the transmission of bending wave energy between faces. Thus, the faces may be both mechanically and acoustically coupled. In this way, a transducer need only be attached to one face and adjacent faces may be driven by bending wave energy which is transmitted across the fold. This may be achieved when the fold or connector resists flexing, i.e. has residual bending stiffness after folding.

Alternatively, the fold or connector may be fully flexible whereby the fold or connector acts as a simply supported edge termination of an excited panel. Thus, the faces adjacent the radiator primarily act as baffles whereby bass response of the radiator may be improved. The baffle may be substantially open or closed.

The box-form structure may be of any suitable geometrical shape, e.g. cuboid, cube-shaped or prism shaped and may be open or closed. For example, the box-form structure may be in the form of a truncated pyramid, preferably having a triangular base. The triangular base means that the side faces adjacent the radiator provide an effective baffle of a greater depth for the radiator than for other shaped bases, e.g. rectangular. The plane of the truncation may be angled, for example at 20°, with respect to the plane of the base of the pyramid.

The stiff lightweight sheet material may be a packaging material such as corrugated cardboard or the like. The corrugated cardboard may be of the kind comprising face skins sandwiching a corrugated core. Alternatively, the stiff lightweight sheet material may be vacuum-formed plastics or extruded twin wall polypropylene sheet, e.g. such as that sold under the trade-mark "Correx", the latter being generally equivalent to corrugated cardboard. The corrugations of the corrugated material may be arranged to extend perpendicular or at an acute angle to the base of the structure. Such materials permit the manufacture of very lightweight, portable, low cost and possible disposable speakers. Alternatively, more durable, long lasting or higher performance sheet materials could be used, e.g. that are sold under the trade mark "Traumalite".

The panel-form bending wave radiator may be resonant and the loudspeaker may be of the distributed mode kind. Thus the properties of the panel-form radiator may be chosen to distribute resonant bending wave modes of the radiator substantially evenly in frequency. In other words, the properties or parameters, e.g. size, thickness, shape, material etc., of the panel-form radiator may be chosen to smooth peaks in the frequency response caused by "bunching" or clustering of the modes.

The box-form structure may be of concertina or fold-out form, and image width may be increased by designing for a multiple concertina fold-out action. For example, a face of the box-form structure may be formed with a fold whereby that face can be folded on itself to collapse the box-form structure. The fold in the face may be substantially central of the face whereby the face can be folded in half to collapse the box-form structure. A tab may be disposed adjacent to the fold and may be integral with a face of the box-form structure. The tab extends across the fold when the structure is erect to prevent folding of the said face in one direction. In this way, the face may be only folded inwards and thus the ability to flat pack the speaker does not necessarily lead to a loss of stability or strength.

The box-form structure may comprise a support flap connected to a face of the box-form structure and which can be folded to abut at least one adjacent face to hold the box-form structure erect. The support flap may abut two adjacent faces, e.g. two side faces and may strengthen the overall structure. The support flap may also act as a spacer between the interior surfaces of two adjacent faces when the box-form structure is collapsed, one of which interior surfaces has the transducer coupled thereto, to provide a cavity for receiving the transducer.

The transducer may be a moving coil inertial exciter comprising a magnet assembly and a voice coil assembly. Since the transducer is mounted on a sloping face, there is uneven weight loading which may lead to unwanted non-axial movement of the magnet assembly. The magnet assembly may thus be supported in a transducer housing mounted to the radiator. The housing may be in the form of a plastic spider which decouples the mass of the transducer from the face. The magnet assembly may be secured to the housing by pads which act as a heat sink. The transducer housing discourages unwanted non-axial movement of the magnet assembly and hence voice coil damage may be alleviated and the transducer excursion may be limited.

Alternatively, the transducer may be an inertial or grounded vibration transducer, a piezoelectric transducer, a magnetostrictive transducer, a bender or torsional transducer (e.g. of the type taught in U.S. patent application Ser. No. 09/384,419 (filed on Aug. 27, 1999)) or a distributed mode transducer (e.g. of the type taught in U.S. patent application Ser. No. 09/768,002 (filed on Jan. 24, 2001)) (each of which is incorporated by reference herein in their entirety).

More than one face may form a panel-form bending wave acoustic radiator. A transducer may be mounted on each face which forms a panel-form bending wave acoustic radiator to excite bending wave vibration in the radiator. By providing transducers on more than one face, stereo sources may be obtained from a single object. A transducer may be mounted to each face of the box-form structure whereby omnidirectivity at high frequencies may be improved.

The loudspeaker may have a pop-up design whereby the loudspeaker may be assembled by a single push or pull action. Alternatively, the speaker may have a snap-out design whereby time and effort required in assembly is reduced. Press studs may be used to maintain the box-form structure, particularly for a pop-up or snap-out design, in its flat-pack arrangement. The speaker may comprise ground engaging feet, which may be pop-up or clip-on feet.

Thus, the invention provides a light-weight fold-away loudspeaker which may be used as a Hi-fi, AV or presentation loudspeaker. Low weight and reduced volume offers improved distribution with lower shipping and warehousing costs. The loudspeaker is also scalable from desktop use to large floor standing box-form structures.

Applications of the technology include foldable versions of the following: a lightweight subwoofer, a multi-media loudspeaker which wraps around a multi-media monitor, e.g. for a PC or laptop, a PA system, a lectern which may incorporate a PA system, a suspended or pole mounted multi-polar announcement system, a musical wigwam, a musical/talking Wendy house, musical toys/models for children to assemble, promotional display loudspeakers, an expandable baffle for portable conferencing/personal hands-free product to improve low frequency, cot-side travel units with soundchip, personal head-worn systems, walk-in portable listening rooms and lampshades.

The "point of purchase" market generally requires displays to be delivered flat-pack. Particularly for the smaller objects, the improved low frequency performance will be useful when, for example, amplifier headroom and battery life are at a premium. The opportunity for images covering the entire object surface is also attractive to merchandisers. Furthermore, the loudspeaker can be made to look like the product or packaging e.g. Weetabix® cereal or a Toblerone® chocolate bar.

Further features and advantages of the invention, as well as the structure and operation of various embodiments of the invention, are described in detail below with reference to the accompanying drawings.

BRIEF DESCRIPTION OF DRAWINGS

Embodiments that incorporate the best mode for carrying out the invention are described in detail below, purely by way of example, with reference to the accompanying drawings, in which:

FIGS. 6*c* and 6*f* are respective perspective and side views of the connector panel of the loudspeaker of FIG. 6*a;*

FIGS. 6*d* and 6*e* are plan and side views of the transducer and transducer housing of the loudspeaker of FIG. 6*a;*

Figure 1:
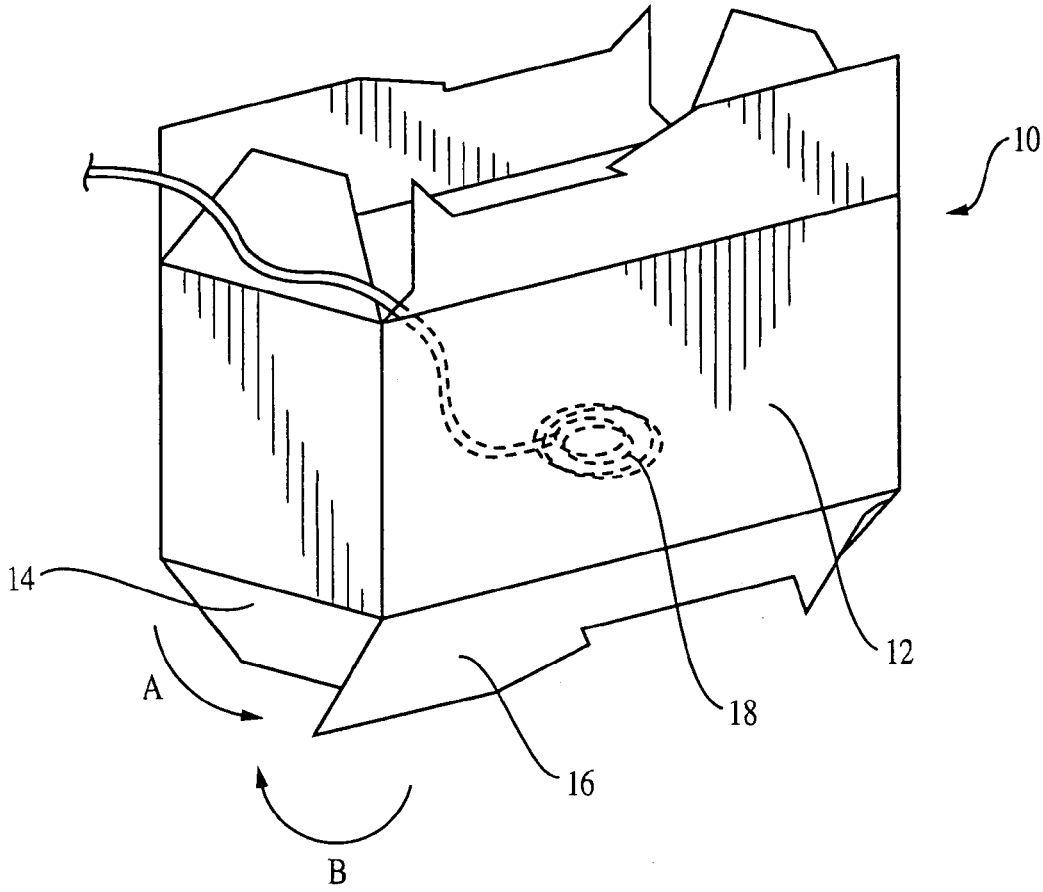
FIG. 1 is a perspective view of a partly assembled loudspeaker according to an embodiment of the present invention.

It is to be understood that the invention is not limited in its application to the details of construction and the arrangement of components of preferred embodiments described below and illustrated in the drawing figures.

DETAILED DESCRIPTION

Figure 2:
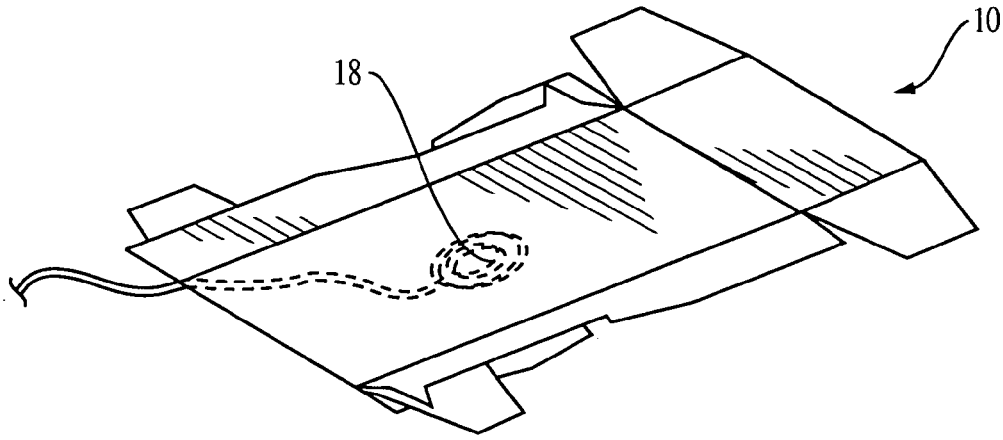
FIG. 2 is a perspective view of the loudspeaker of FIG. 1 in flat-pack form.

FIGS. 1 and 2 show a loudspeaker 10 according to the present invention. In FIG. 2, the loudspeaker 10 is in flat pack form, i.e. for transport and storage. In FIG. 1 the loudspeaker 10 is partially assembled with the loudspeaker 10 being completed by folding upper and lower flaps inwards to form a generally cuboid structure, i.e box. As shown, lower side flap 14 and lower front flap 16 are folded inwards in the directions of arrows A and B respectively. FIG. 3*e* shows the fully assembled form of the loudspeaker which has a cuboid box-structure.

The loudspeaker has a box-form structure with a plurality of faces which define a volume. The front face 12 forms a panel-form bending wave acoustic radiator which is capable of supporting bending wave vibration, preferably resonant bending wave modes. A transducer 18 is coupled to the front face 12 to drive bending wave vibration in the panel to produce an acoustic output. The transducer 18 is shown in dotted line and is mounted on the inner side of the front face 12, i.e. within the box (when fully assembled).

FIGS. 3*a* to 3*f* show six alternative erected box-like loudspeakers. Each loudspeaker may have a base and thus define a closed box. Alternatively the base may be defined by the surface on which the loudspeaker stands. FIGS. 3*a*, 3*b*, 3*c* and 3*f* show prisms each having four side faces extending from a rectangular base. In each of FIGS. 3*a*, 3*b* and 3*c* two opposed side faces are perpendicular to the base and the prisms have a constant cross-section defined by the opposed faces.

Figure 3A:
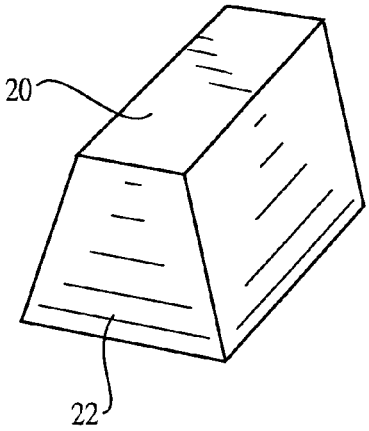
FIGS. 3*a* to 3*f* are perspective views of loudspeakers according to six alternative embodiments.
Figure 3B:
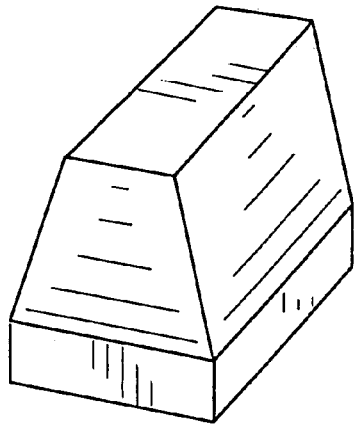
Figure 3C:
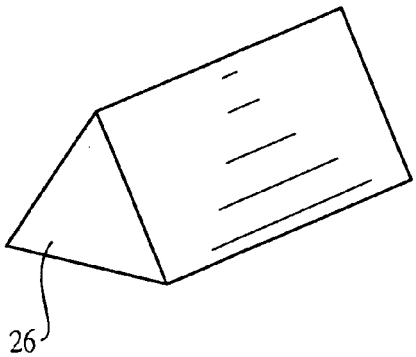
Figure 3D:
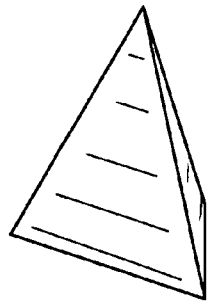
Figure 3E:
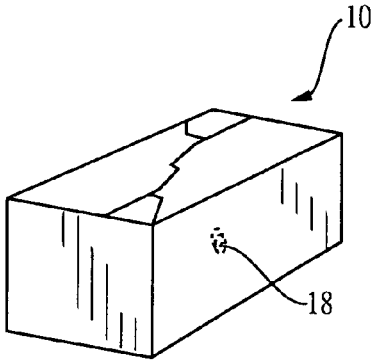
Figure 3F:
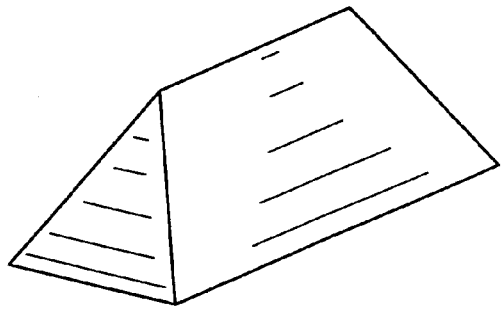

In FIG. 3*a* the prism has a rectangular top face 20 to which the four faces extend and the two opposed side faces 22 of the prism are trapezium-shaped. FIG. 3*b* shows a complex prism comprising the prism of FIG. 3*a* mounted on a cuboid. FIG. 3*c* shows a prism in which the four side faces meet in a line with the two opposed side faces 26 being triangular. FIG. 3*f* shows a prism similar to that of FIG. 3*c* except that each side face is inclined at an acute angle to the rectangular base. FIG. 3*d* shows a tetrahedral in which each face, including the base, is triangular.

Figure 4:
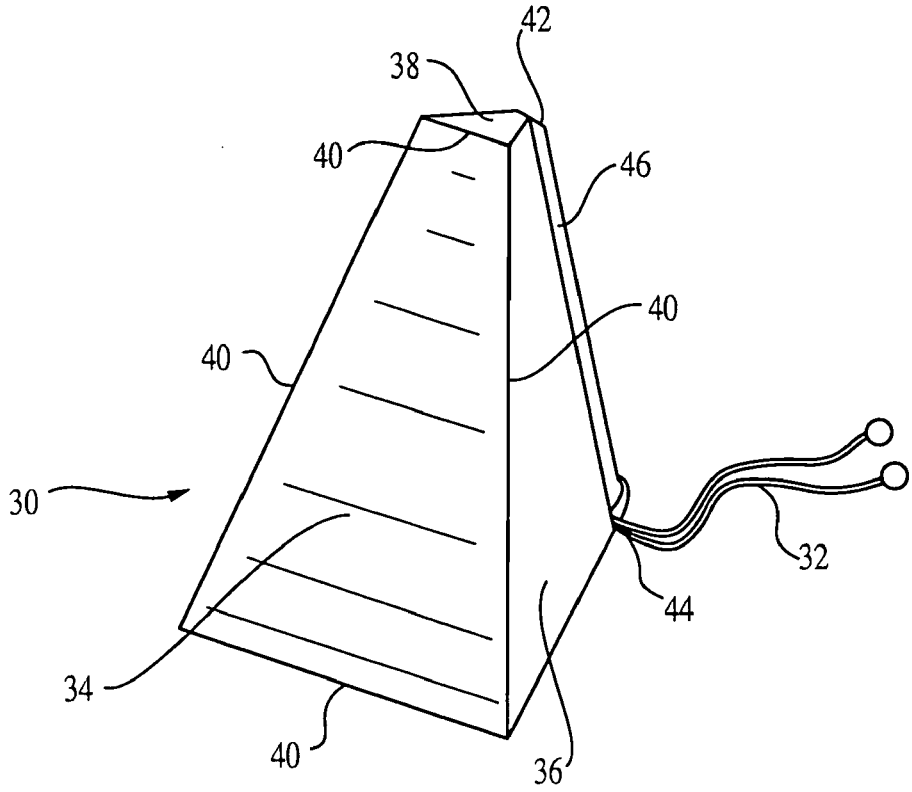
FIG. 4 is a perspective view of a loudspeaker according to another aspect of the invention.

FIG. 4 is a loudspeaker 30 having an erected box-form structure in the form of a truncated pyramid having an equilateral triangular base. The plane of the truncation in this example embodiment is angled at approximately 20° to the plane of the base of the pyramid. Other truncation angles are also contemplated. A triangular base shape provides the largest ratio of side face to overall box size. The pyramid is made from a corrugated cardboard having a high stiffness to mass ratio and a high quality clay-coated surface finish which is particularly suitable for printing any desired design on the faces of the pyramid. The cardboard is of the kind comprising face skins sandwiching a corrugated core.

A transducer (not shown) is mounted to one face of the pyramid and is connected to an audio signal by audio connections 32. Since there is only one transducer, only one face 34 of the loudspeaker is excited directly and this face forms a panel-form bending wave acoustic radiator. The other two side faces 36, the base and the top face 38 are mechanically coupled to the excited face by folds 40 whereby the excited face is simply supported along all of its edges. The other two side faces 36 primarily act as baffles for the excited face. There may be transmission of vibrational energy across the folds 40 whereby the other faces, in particular, the other two side faces 36 are also acoustically coupled to the excited front face 34 and may thus be excited.

Figure 4A:
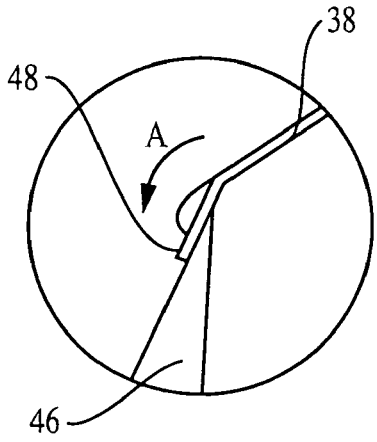
FIGS. 4*a* and 4*b* show upper and lower releasable locking mechanisms for the loudspeaker of FIG. 4.
Figure 4B:
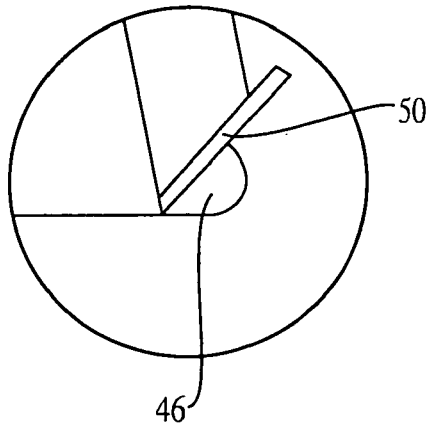

As with previous embodiments, the box-form structure is intended to fold flat for ease of transport and/or storage. Thus pairs of faces are connected by single continuous folds which act as hinges whereby the two faces are rotatable relative to each other. The loudspeaker 30 comprises upper and lower releasable locking mechanisms 42, 44 which connect to a flange 46 which extends along the fold joining each of the two side faces 36. FIG. 4*a* shows the upper mechanism 42 which comprises a flap 48 which folds down from the top face 38 in the direction of arrow A and is secured to the flange 46 by a fastener. FIG. 4*b* shows the lower mechanism 44 which comprises a flap 50 which folds across from the side face and is secured to the flange 46 by a fastener. The fasteners may be Velcro™ or the like or fastener disks whereby easy assembly and disassembly of the loudspeaker is achieved.

Figure 5:
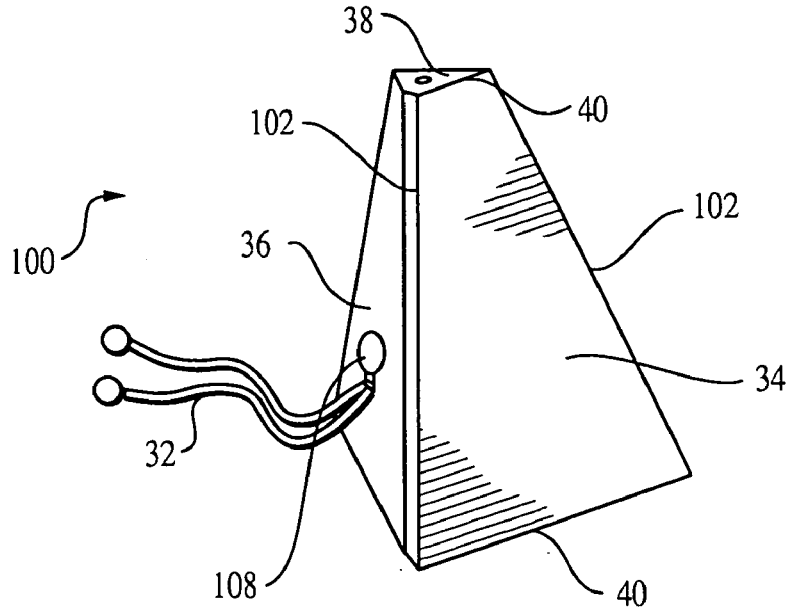
FIG. 5 is a perspective view of a loudspeaker according to another aspect of the invention.

FIG. 5 shows a loudspeaker 100 which is generally similar to that of FIG. 4 and thus features in common have the same reference numbers. In contrast to FIG. 4, in FIG. 5 the front face 34 is connected to the two side faces 36 by a fold 102 having a parallel pair of folds. The audio connections 32 are connected to a connector panel 108 (see FIG. 6*c*).

Figure 5A:
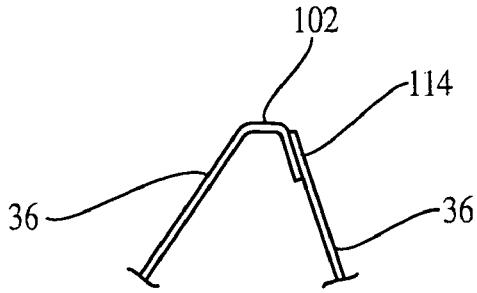
FIGS. 5*a* and 5*b* are cross sections of the rear spine and the side spines of the loudspeaker of FIG. 5.
Figure 5B:
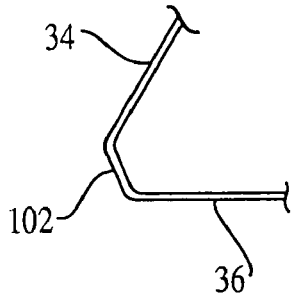
Figure 5C:
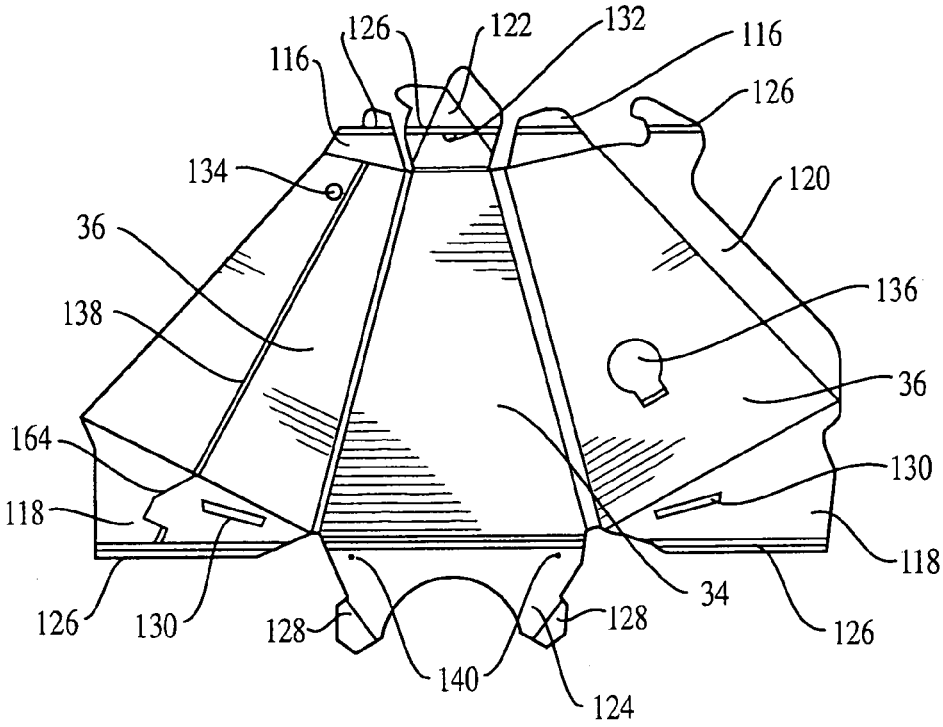
FIG. 5*c* is a plan view of the loudspeaker of FIG. 5 before assembly.

FIG. 5*a* shows the rear spine which connects the two side faces 36 and which is in the form of a double fold 102 permanently attached by a glued joint 114 joining a flap on one side face with the other side face. FIG. 5*b* shows one of the folds which connects the front face 34 with a side face 36 and which is in the form of a double fold 102.

FIGS. 5*c* to 5*f* illustrate the manufacture of the loudspeaker of FIG. 5 from a specially formed blank of a single piece of cardboard. The blank shown in FIG. 5*c* comprises integral panels which are in the form of generally truncated triangles and which when the loudspeaker is erected as a box form its front and side faces 34, 36. The panel forming the front face 34 is integral with an upper central flap 122 and a lower central flap 124 which respectively form the top and base faces of the assembled loudspeaker. The lower central flap 124 is formed with two holes 140 which ensure correction alignment of a transducer mounting jig whereby the transducer may be accurately positioned on the front face 34. The upper central flap is generally triangular with two additional side pieces and is formed with a central hole 132 to assist in assembly.

Each panel forming a side face 36 is integral with an upper and a lower side flap 116, 118 and the flaps may be moved relative to the side faces along single folds. One side face 36 comprises a central fold 138 and a small hole 134 towards the top of the face to assist in collapsing the box-form structure. The other side face 36 comprises a hole 136 into which the connector panel is inserted and the face is integral with a side flap 120 which is folded over to form the glued joint. Each lower side flap 118 comprises a slot 130 corresponding to a tab 128 on the lower central flap 124. The lower side flap 118 integral with the side face 36 having the central fold 138 is formed in two pieces. One piece has a tab 164 which prevents outward movement along the fold 138 when the box-form structure is assembled. A strip of sticky tape 126 is attached to each of the upper and lower flaps.

The cardboard comprises two face skins sandwiching a corrugated core which comprises two fluted layers separated by an intermediate skin layer. The upper fluted layers is formed from 180 gsm white top Kraft paper, i.e. paper with a high content of wood pulp mixed with some recycled paper, and the lower fluted layer is formed from 190 gsm light-weight-clay coated paper. The cardboard is thus of type BE 190Y 180W. The flutes of the cardboard are arranged perpendicular to the base of the front face orientation whereby the front face is stiffer in a direction parallel to the base than in the direction perpendicular to the base. As a result of the shape of the blank, the flutes of the cardboard in the panels forming the side faces are at an acute angle to the base of each side face.

Each of the folds between the panels is formed by pressing the cardboard to form grooves or creases. The crease may be made when the blank is die-cut by using a strip of steel on the die which has a rounded edge and is set in the die such that the strip pushes in to the sheet only to the required depth. The central fold on one side panel may be formed by pressing a crease, using a rubber strip on the platen of the press which forms the other creases. The central fold 138 folds in the opposite direction to the other folds between panels and thus the crease is formed on the opposite face of the blank to the other creases.

Figure 5D:
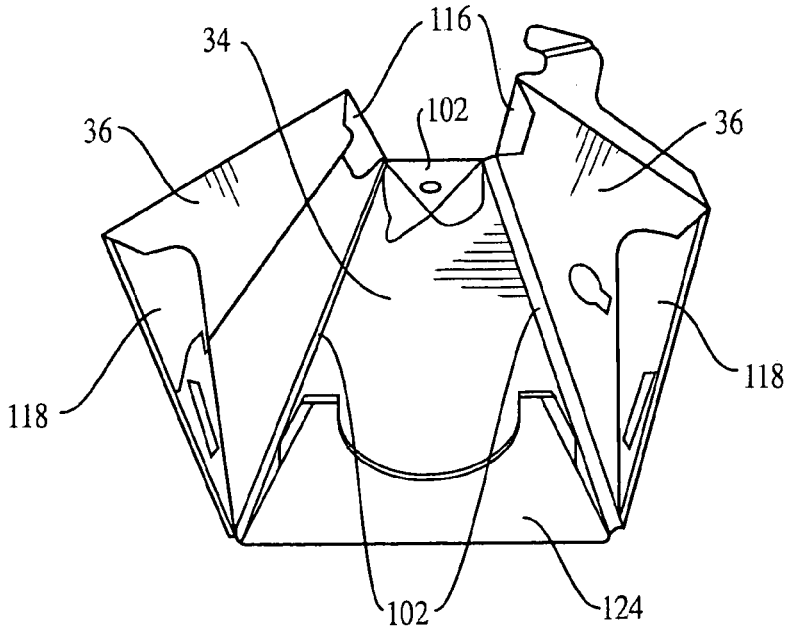
FIGS. 5*d*, 5*e* and 5*f* are perspective views of the loudspeaker of FIG. 5 at various stages during assembly.
Figure 5E:
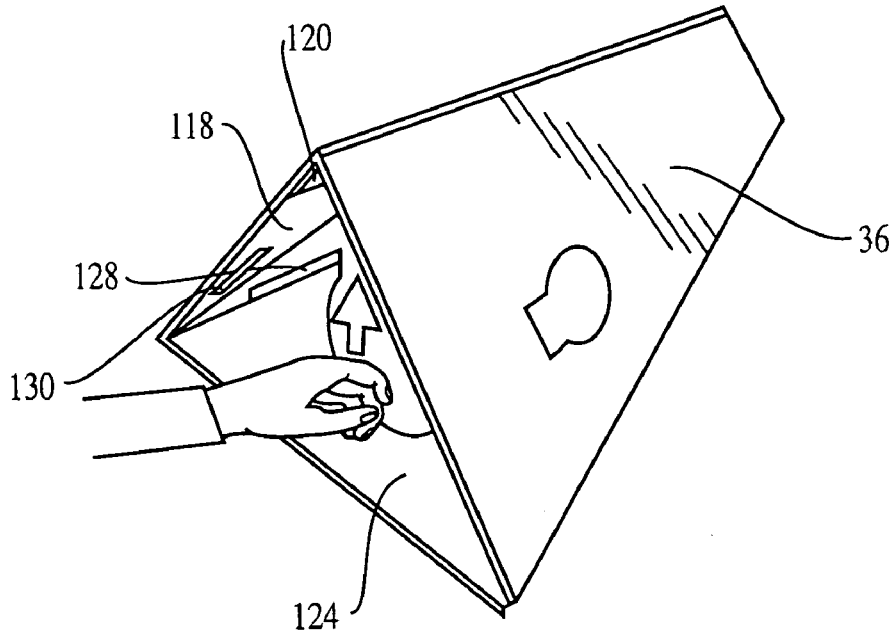
Figure 5F:
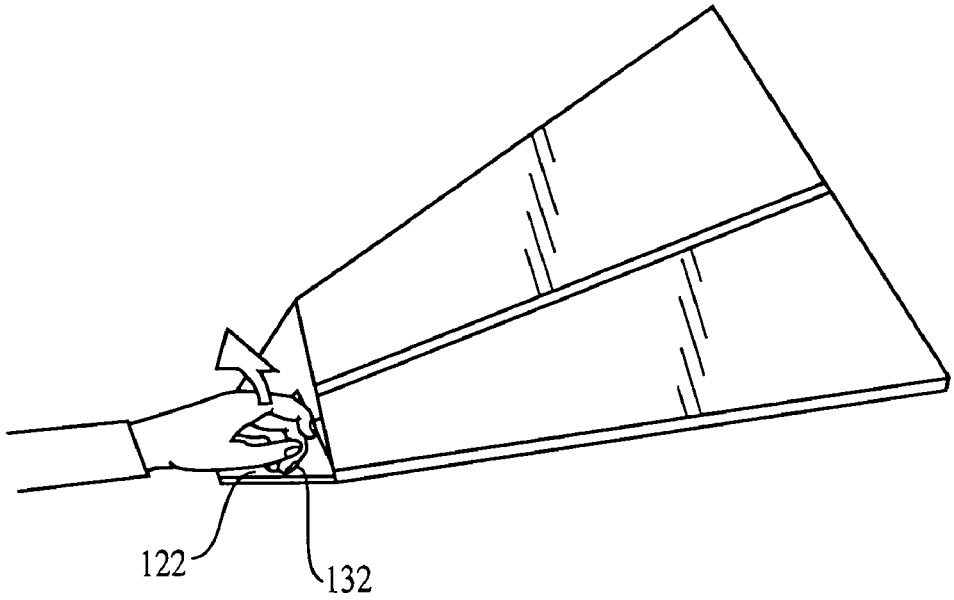

The box-form structure of the loudspeaker is assembled as follows. The transducer and connector panel are preferably secured to the relevant faces before the box-form structure is assembled.

a) Fold upper and lower side flaps 116, 118 onto respective side faces 36; the sticky tape 126 bonds the flaps to the faces (see FIG. 5D). A hot melt process would achieve the same effect.

b) Fold upper and lower central flaps 122, 124 towards the front face 34. By folding over the various flaps, the number of exposed cut surfaces is reduced. Thus, if the speaker is formed from cardboard, the water resistance of the speaker may be improved.

c) Fold side faces 36 inwards along the folds 102 having a pair of parallel folds.

d) Form the rear spine joining the two side faces 34 by gluing the side flap 120 to one side face.

e) Pull lower central flap 124 away from the front face in the direction of the arrow in FIG. 5E and lock the tabs 128 into the respective slots 130. The lower central flap 124 abuts both side faces 36 and acts as support flap and strengthens the overall structure.

f) Pull upper central flap 122 using central hole 136 away from the front face in the direction of the arrow in FIG. 5F. This locks the top face in place and assembly is now complete.

Figure 5G:
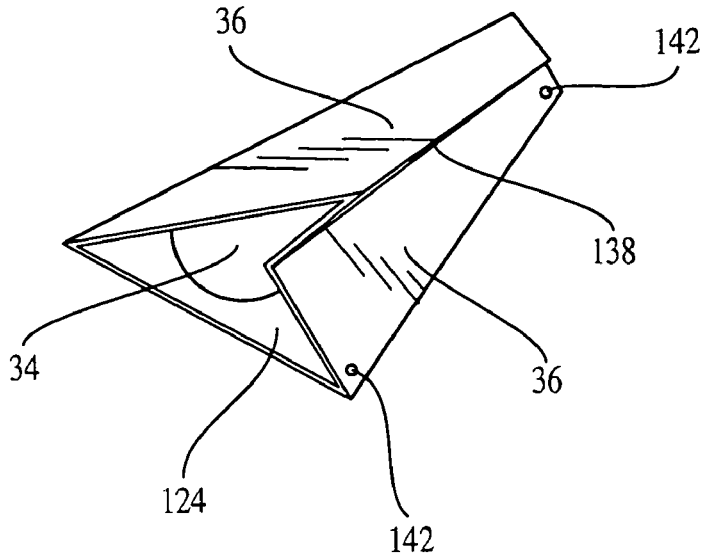
FIG. 5*g* is a perspective view of the assembled loudspeaker of FIG. 5 in flat-pack form.

The assembled speaker is collapsible into flat pack form as shown in FIG. 5G. First the top face is removed from its locked position by exerting pressure through the hole 134 on the side face 36. The box-form structure is then collapsed inwards along the fold 138 extending along the side face so that 1800 of folding is achieved. The collapsed side face together with the other faces defines a W-shaped cross-section. The box-form structure may be erected again as a box by unfolding the collapsed fold and thus the structure may be considered to be of concertina form.

The box-form structure is optionally held flat by press studs 142 or other fasteners. The lower central flap 124 (or support flap) acts as a spacer between interior surfaces of the front and side faces so that a cavity is provided for receiving the transducer. Alternatively the double folds 102 may act as spacers or holes may be cut in the side faces to allow clearance for the transducer assembly when the speaker is folded down.

Figure 6F:
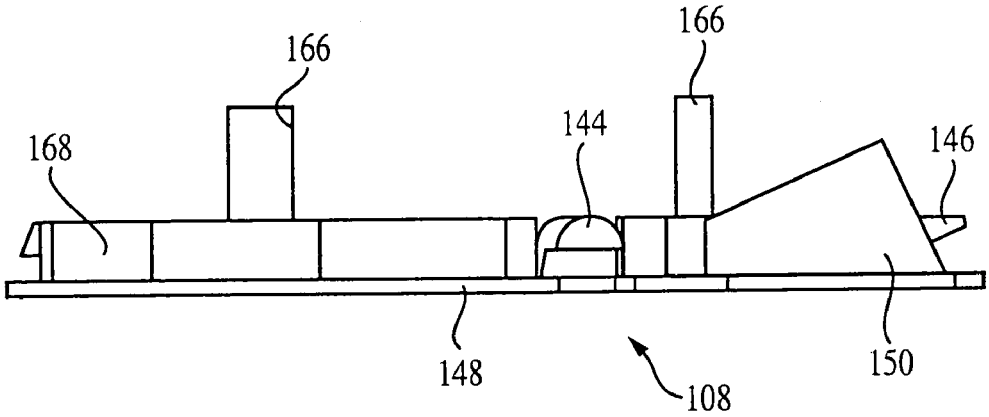
Figure 6A:
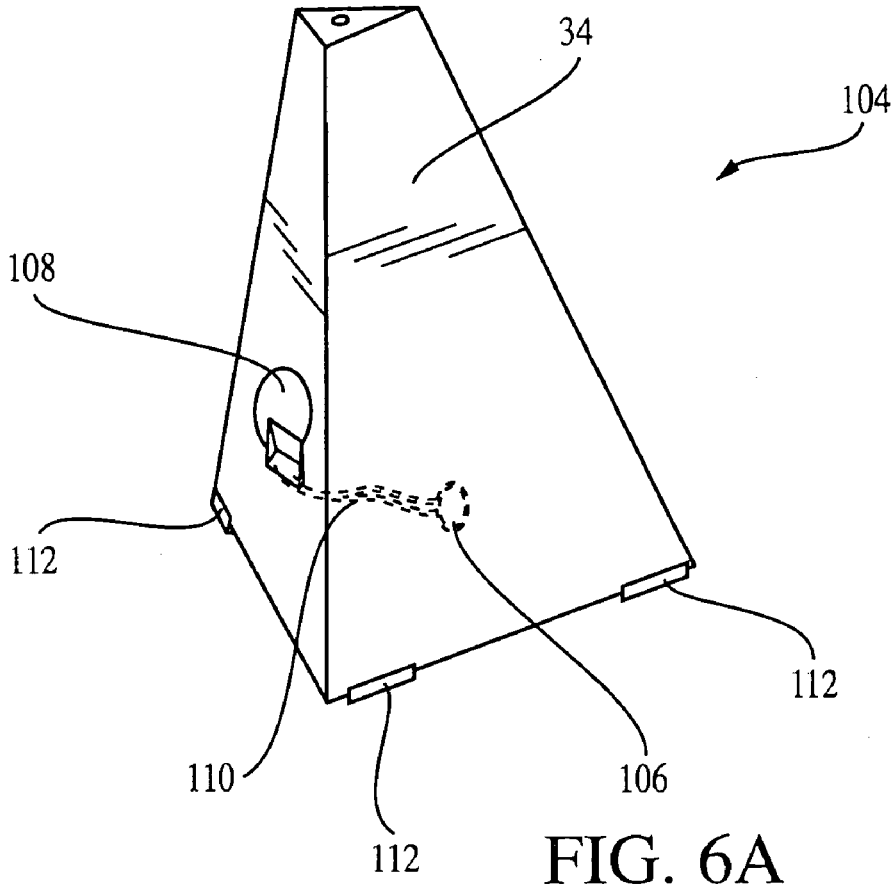
FIG. 6*a* is a perspective view of a loudspeaker according to another aspect of the invention.
Figure 6B:
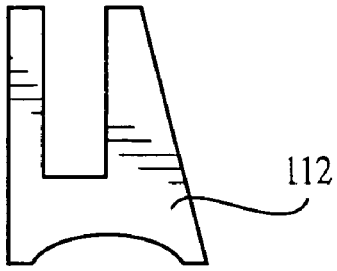
FIG. 6*b* is a cross-section through a foot for the loudspeaker of FIG. 6*a;*

FIG. 6*a* shows a loudspeaker 104 which is generally similar to that of FIGS. 4 and 5 and thus features in common have the same reference numbers. FIG. 6*a* shows the position of the transducer 106 which is mounted on the interior surface of the excited front face 34. The transducer location is selected so as to optimise the acoustic output from the speaker. The transducer 106 is connected to the connector panel 108 by connections 110. Ground engaging feet 112 shown in FIG. 6*b* are attached to the base of the loudspeaker 104.

FIGS. 6*c* and 6*f* shows the connector panel 108 which comprises a generally circular plate 148 having three snap-fit connectors 144 whereby the connector panel is secured to a side face of the box-form structure. The plate 148 is integrally formed with a box-like member 150 having a terminal port 146 linking audio connections from an audio source with the connections to the transducer. The connections may be fitted with a quick release connector to avoid damage to the transducer if the cable is pulled violently. The plate 148 is formed with feet 166 and a rim 168 which all protrude from an interior face to define a cavity which protects the transducer when the box-form structure is flat packed.

FIGS. 6*d* and 6*e* show the transducer 106 and its housing 152. The transducer is a moving coil inertial exciter comprising a magnet assembly 154 and a voice coil assembly 156. The transducer 106 is connected to the connector panel by connections 110. Since the transducer is mounted on a sloping face, there is uneven weight loading which may lead to unwanted movement of the magnet assembly. Thus, in addition to mounting the voice coil assembly 156 directly to a face of the box-form structure, the magnet assembly 154 is supported in a transducer housing 152.

The transducer housing 152 is in the form of a plastic spider which decouples the mass of the transducer from the face. The spider comprise a cup 155 which covers the transducer 106 and three curved arms 158 extending away from the cup 155. Each distal end of the arms 158 is mounted to the face by resilient sticky pads 160. The magnet assembly 154 is secured to the cup 155 by resilient foam pads 162 which can also act as a heat sink. The transducer housing discourages unwanted non-axial movement of the magnet assembly and hence voice coil damage may be alleviated and the transducer excursion may be limited.

FIGS. 7*a* to 10*a* show alternative hinge mechanisms or folds for connecting pairs of faces in the loudspeakers. In FIGS. 7*a* to 8*b* and FIG. 10*a*, the hinge is integral with the faces and thus adjacent faces may be formed from a single piece of material. In FIGS. 9*a* and 9*b* the hinge is a discrete member which is connected to both faces and thus both faces may be formed from separate pieces of material.

Figure 7A:
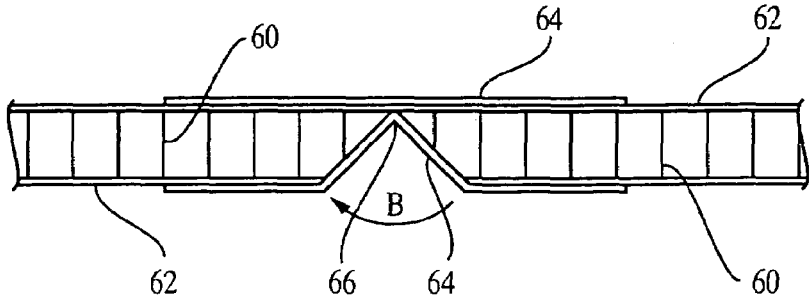
FIGS. 7*a*, 8*a* and 9*a* and 7*b*, 8*b* and 9*b* are exploded cross-sections of alternative hinge mechanisms in the open and closed state respectively.
Figure 7B:
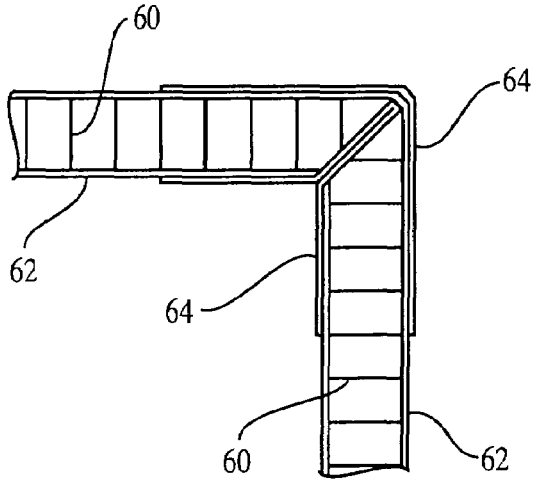

The loudspeaker may be made from a foldable material, e.g. a monolith or a skinned panel with a collapsible core. A hinge can be made with V-grooving as shown in FIGS. 7*a* and 7*b*. FIGS. 7*a* and 7*b* show the hinge in its open and closed states which correspond to the loudspeaker in flat pack form and assembled box-form respectively. Each face is made from a composite panel which comprises a core 60 sandwiched between two skins 62. A V-shaped section of the core, including one skin, is cut-away with the point of the V-shape defining the fulcrum 66 about which the faces are rotatable relative to each other. One face is rotatable in the direction of Arrow B from a position in which both faces are in the same plane (FIG. 7*a*) to a position in which both faces are perpendicular to each other (FIG. 7*b*). Reinforcing tape 64 is added along both sides of the panel in the region of the groove, the tape runs inside the closed hinge.

Figure 8A:
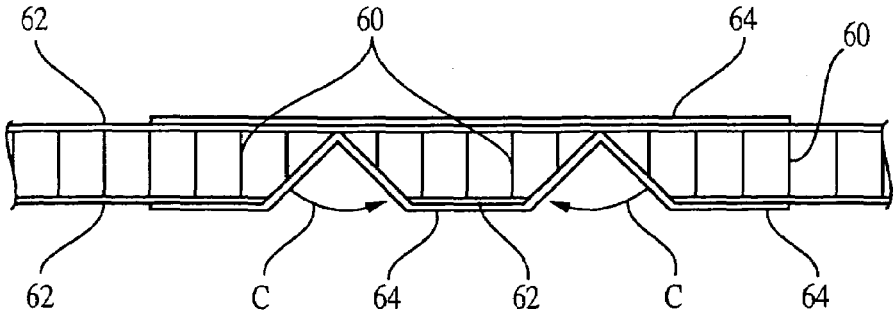
Figure 8B:
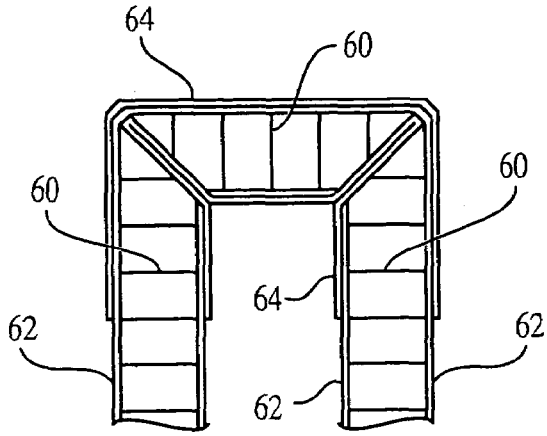

FIGS. 8*a* and 8*b* show a double hinge comprising two of the V-grooves illustrated in FIGS. 7*a* and 7*b* and thus the same reference numbers are used. Each face is rotated in the directions of arrows C and D from a position in which both faces are in the same plane to a position in which both faces are parallel but not co-planar. Thus 180° of folding is achieved.

Figure 9A:
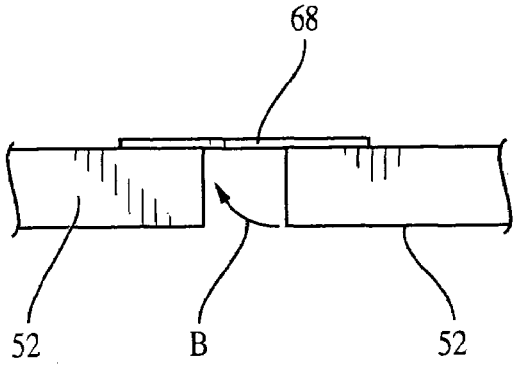
Figure 9B:
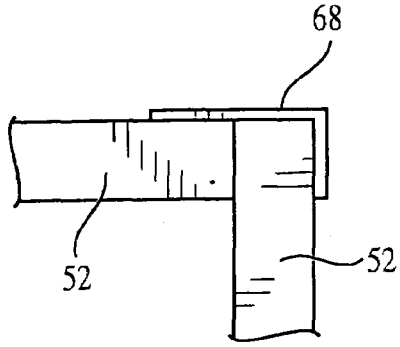

FIGS. 9*a* and 9*b* show two faces 52 which are spaced apart so as to define a gap which is approximately equal to the thickness of each face and which are connected by a connector in the form of a strip of self adhesive tape 68 which forms a hinge. One face is rotatable in the direction of Arrow B from a position in which both faces are in the same plane (FIG. 9*a*) to a position in which both faces are perpendicular to each other (FIG. 9*b*). The tape is chosen to have a high degree of internal damping and a suitable high tack adhesive. If the face is made from a milled core, the tape may prevent loose edges from rattling and buzzing. This arrangement is appropriate if the faces are not made from a foldable material.

Figure 10A:
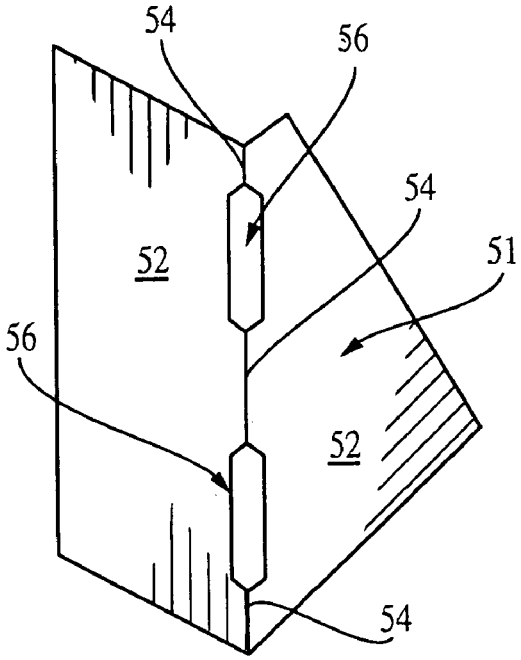
FIG. 10*a* is a perspective view of a loudspeaker according to another aspect of the invention, showing an alternative hinge mechanism.

FIG. 10*a* shows a discontinuous single hinge 51 connecting two faces 52. The hinge 51 comprise folds 54 and cutaway sections or openings 56 between the folds.

The hinge or fold should be sufficiently flexible to allow the loudspeaker to be flat packed. The flexibility of the hinge may range from substantially resistant to flexing to fully flexible. If fully flexible the hinge acts as a simply supported edge termination of an excited panel and little or no bending wave energy is transmitted across the hinge. Alternatively, if the hinge resists flexing, i.e. has residual bending stiffness after folding, bending wave energy may be transmitted across the hinge from an excited face to an adjacent face. Although there may be losses as frequencies increase, the hinge may be designed to transmit bending wave energy of all frequencies in the operative range, i.e. at least up to 20 KHz.

Figure 10B:
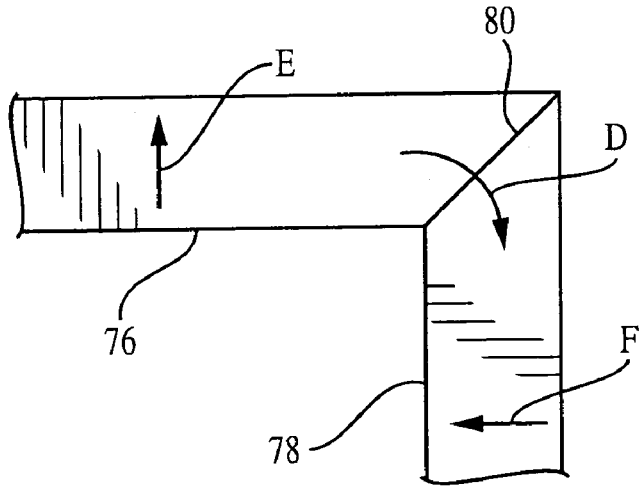
FIG. 10*b* is an exploded cross-section of a hinge showing the transmission of energy across the hinge.

FIG. 10*b* illustrates the transmission of bending wave energy from a driven face 76 to an adjacent face 78 across a hinge 80. The bending wave energy in the driven face causes a rotational pivoting action (arrow D) about the longitudinal axis of the hinge 80 which drives bending wave energy into the adjacent face 78. Bending waves from the driven face 76 arrive at the hinge 80 as local lateral angular displacements which are translated by the hinge into opposite polarity displacements in the adjacent face 78. The opposite polarity displacements have equal and opposite angles to the original displacements and drive bending waves into the adjacent face 78 as a result of the areal mass, stiffness and inertia of the face 78. As indicated by arrows E and F which shows the direction of local bending wave vibration in the driven face 76 and the adjacent face 78 respectively, the adjacent face 78 is excited in anti-phase to the driven face 76.

Figure 11:
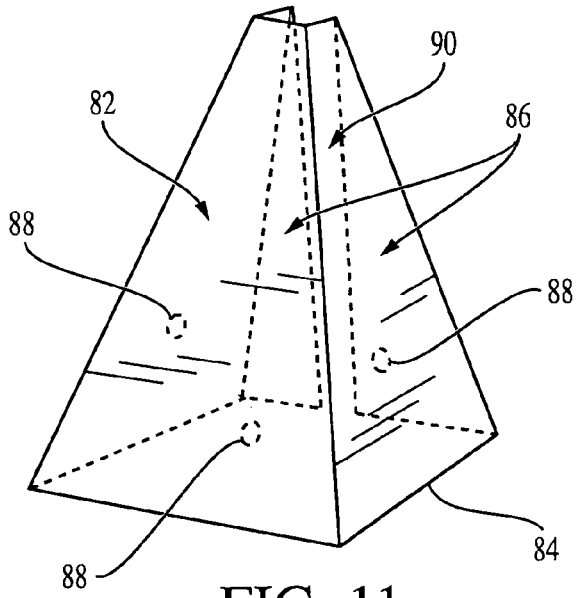
FIGS. 11, 12*a* and 12*b* are perspective views of alternative speakers.
Figure 12A:
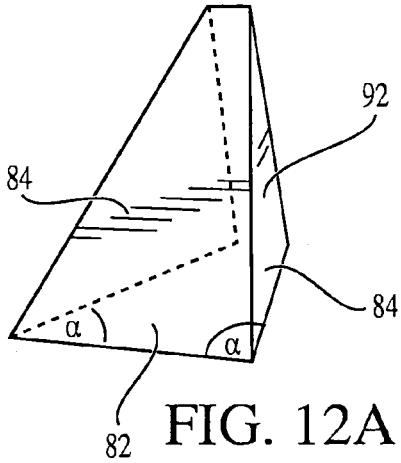
Figure 12B:
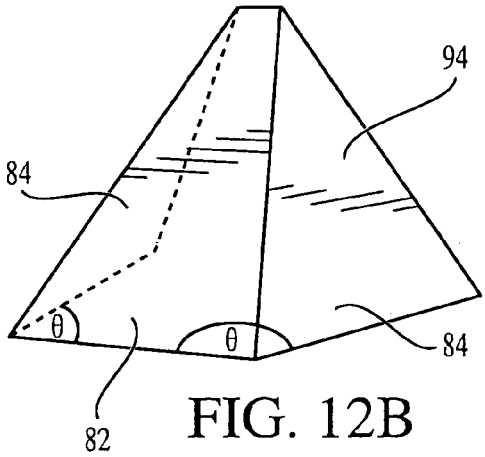

FIGS. 11, 12*a* and 12*b* show box-form structures which are open, i.e. at least one face is fully or partially missing or removed. In FIG. 11, the speaker is generally in the form of a truncated square based pyramid. The speaker has generally triangular shaped front and side faces 82,84 and a transducer 88 is mounted to each of these faces whereby each face forms a separately driven panel-form bending wave acoustic radiator. The rear face 86 is passive but may be modally active via acoustic coupling across the hinge as explained previously. The rear face 86 comprises two sections separated by a gap which acts as a vent to the loudspeaker. The rear face 86 controls the motion of the rear edges of the side faces 84. The rear face adds to the effective baffle size, whereby bass response may be improved.

In FIGS. 12*a* and 12*b*, the loudspeaker comprises a truncated triangular front face 82 and two triangular side faces 84. The front face 82 is driven by a transducer (not shown) and the side faces 84 act as baffles. The rear edges of the side faces define an open rear face 92,94. FIG. 12*a* shows a substantially closed baffle in which the rear edges of the side faces almost meet. Thus, the open rear face 92 is small and the lower edge of each side face is at an acute angle $\alpha$ to the lower edge of the front face. FIG. 12*b* shows a substantially open baffle in which the open rear face 94 is large and the lower edge of each side face is at an obtuse angle $\theta$ to the lower edge of the front face. More open baffles generally have greater bass weight.

Figure 13:
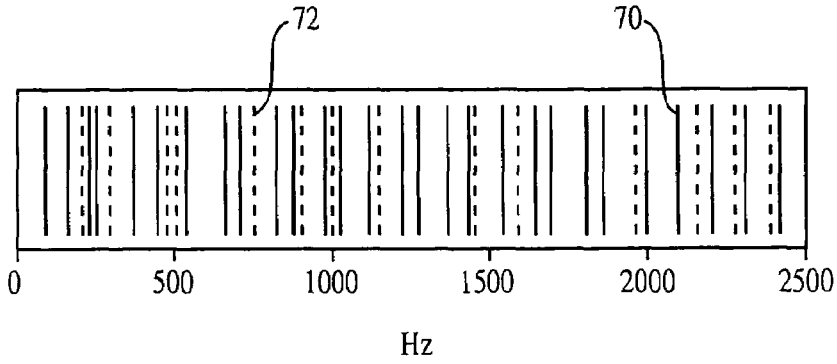
FIG. 13 is the modal distribution of two bending wave panels which may be used in the loudspeaker shown in FIG. 4.

In each embodiment, each panel-form bending wave acoustic radiator may be a distributed mode radiator as taught in U.S. Pat. No. 6,332,029 and others to the present applicant, and thus the properties of the panel-form radiator may be chosen to distribute resonant bending wave modes of the radiator substantially evenly in frequency. Turning in particular to the size, as shown in FIG. 13, the modal distribution 70 for a large triangular panel-form radiator is more dense, more evenly distributed and extends to lower frequencies than the modal distribution 72 for a radiator of a similar shape which is 50% smaller. In particular, the larger radiator has more evenly distributed low frequency modes (i.e. modes below 500 Hz). Such a substantially even distribution may be achieved by interleaving low frequency modes associated with each conceptual axis of the panel-form radiator.

Figure 14:
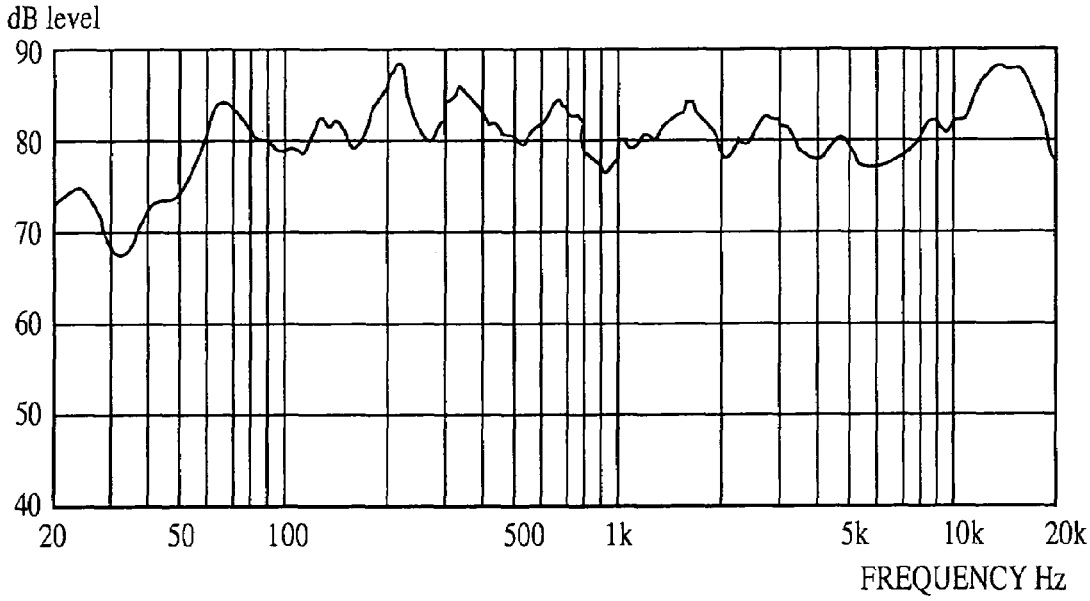
FIG. 14 is the acoustic response (sound pressure level in dB versus frequency) for the loudspeaker of FIG. 5.

Appropriate selection of the parameters of the loudspeaker and transducer location contribute to providing a good acoustic output. FIG. 14 shows the frequency response for the speaker of FIG. 5 which has a trapezium shaped front face having two parallel sides, i.e. base and top side, of length 515 mm and 157 mm and height (i.e. distance between the two parallel sides) of 715 mm. The transducer is mounted to the inner surface of the front face at a location which is 256 mm from the base side and 52 mm from the panel centre line.

FIG. 14 shows that the sound pressure level averages 84 dB (±5 dB) over a frequency range extending from approximately 50 Hz to 15 kHz. The sound pressure level is measured at 1 meter from the front face for an input of 1 watt. The triangular base means that the side faces provide an effective baffle of a greater depth for the excited side than for other shaped bases, e.g. rectangular. This combined with simply supporting the excited face on all sides may increase the density of modes in the 150 Hz to 500 Hz region compared to other shaped bases.

Below 100 Hz, there are two peaks in the frequency response, the first at approximately 40 Hz is caused by the fundamental exciter resonance and the second peak at approximately 70 Hz is the first resonant bending mode of the excited face. The first mode is low enough to give a perceived depth of bass. The bass response is also usefully extended by setting the fundamental resonance of the transducer below that of the radiator.

The invention thus provides a simple and highly portable loudspeaker with a wide variety of applications and markets. Although the invention has been described with reference to packaging materials such as corrugated cardboard, it will be appreciated that more durable, long lasting or higher performance sheet materials could also be appropriate to form the speaker.

In all embodiments, the transducer may be any known exciter or actuator which is suitable. For panel-form bending wave acoustic radiators in the form of distributed mode radiators, the transducer location may be chosen to couple substantially evenly to the resonant bending wave modes. In particular, the transducer location may be chosen to couple substantially evenly to lower frequency resonant bending wave modes. In other words, the transducer may be at a location where the number of vibrationally active resonance anti-nodes is relatively high and conversely the number of resonance nodes is relatively low.

While the invention has been described in detail and with reference to specific embodiments thereof, it will be apparent to one skilled in the art that various changes and modifications can be made therein without departing from the scope of the invention. Thus, the breadth and scope of the present invention should not be limited by any of the above-described exemplary embodiments, but should be defined only in accordance with the following claims and their equivalents.

The invention claimed is:

1. A loudspeaker, comprising:

a box-form structure made from a single sheet of stiff lightweight sheet material having one or more folds which define a plurality of faces, with a first face and a second face of the structure respectively forming first and second panel-form bending wave acoustic radiators, the first and second faces being adjacent with a fold therebetween; and an electro-acoustic vibration transducer coupled to the first face to apply bending wave energy to the first radiator to cause it to radiate an acoustic output when an input signal is applied to the transducer, wherein the sheet of stiff lightweight material is sufficiently flexible at the fold(s) to be collapsible to a flat form for at least one of storage and transportation and re-erectable as a box form for use as a loudspeaker, and wherein the second face is driven by bending wave energy which is transmitted across the fold between the adjacent first and second faces.

2. A loudspeaker according to claim 1, wherein a fold between at least two adjacent faces comprises a parallel pair of folds.

3. A loudspeaker according to claim 1, wherein the one or more folds are formed by grooving the sheet material.

4. A loudspeaker according to claim 3, wherein the grooving comprises local compression of the sheet material.

5. A loudspeaker according to claim 1, wherein the box-form structure comprises a plurality of panels made from stiff lightweight sheet material united at panel edges by connectors.

6. A loudspeaker according to claim 5, wherein the connectors comprise hinge portions.

7. A loudspeaker according to claim 5 or claim 6, wherein the connectors permit the transmission of bending wave energy between panels.

8. A loudspeaker according to claim 1, wherein the one or more folds are discontinuous.

9. A loudspeaker according to claim 1, wherein the box-form structure is a truncated pyramid.

10. A loudspeaker according to claim 9, wherein the plane of the truncation is angled with respect to the plane of the base of the pyramid.

11. A loudspeaker according to claim 1, wherein the radiators are resonant.

12. A loudspeaker according to claim 11, wherein the radiator comprises a distributed mode resonator.

13. A loudspeaker according to claim 1, wherein the box-form structure is open.

14. A loudspeaker according to claim 1, wherein the box-form structure comprises ground engaging feet.

15. A loudspeaker according to claim 1, further comprising:

an additional vibration transducer coupled to another of the plurality of faces.

16. A loudspeaker according to claim 1, wherein the box-form structure comprises one of concertina and fold-out form.

17. A loudspeaker according to claim 16, wherein at least one face of the box-form structure is formed with a fold whereby said face is foldable on itself to collapse the box-form structure.

18. A loudspeaker according to claim 17, wherein the fold in said face is formed substantially central of said face, whereby said face can be folded in half to collapse the box-form structure.

19. A loudspeaker according to claim 17 or claim 18, further comprising:

a tab disposed adjacent to the fold and integral with said face, the tab extending across the fold when the structure is erect to prevent folding of the said face in one direction.

20. A loudspeaker according to claim 1, further comprising:

a support flap connected to one of the plurality of faces of the box-form structure and which can be folded to abut at least one adjacent face to hold the box-form structure erect.

21. A loudspeaker according to claim 20, wherein the support flap is adapted to abut two adjacent faces.

22. A loudspeaker according to claim 20 or claim 21, wherein the support flap provides a spacer between the interior surfaces of two adjacent faces when the box-form structure is collapsed, one of which interior surfaces has the vibration transducer coupled thereto, to provide a cavity for receiving the vibration transducer.

23. A loudspeaker according to claim 1, further comprising:

a fastener to maintain the box-form structure flat when collapsed.

24. A loudspeaker according to claim 1, wherein the stiff lightweight sheet material comprises corrugated cardboard having face skins sandwiching a corrugated core.

25. A loudspeaker according to claim 24, wherein the box-form structure defines a front face having a base and at least one side face and wherein the corrugated core is arranged so that its corrugations extend perpendicular to the base.

26. A loudspeaker according to claim 25, wherein the at least one side face has a base and wherein the orientation of the corrugations in the at least one side face is at an acute angle to its base.

27. A loudspeaker according to claim 1, wherein the vibration transducer comprises an inertial electrodynamic device having a coil assembly coupled to the first radiator and a magnet assembly resiliently suspended on the first radiator.

28. A loudspeaker according to claim 27, wherein a spider structure resiliently suspends the magnet assembly on the first radiator to prevent non-axial motion of the magnet assembly relative to the coil assembly.

29. A loudspeaker according to claim 2, wherein the folds are formed by grooving the sheet material.

30. A loudspeaker according to claim 29, wherein the grooving comprises local compression of the sheet material.

31. A loudspeaker according to claim 5 or claim 6, wherein the connectors are discontinuous.

32. A loudspeaker according to claim 23, wherein the fastener comprises at least one press stud.

* * * * *